US006257093B1

(12) United States Patent
Bergacker

(10) Patent No.: US 6,257,093 B1
(45) Date of Patent: Jul. 10, 2001

(54) VEHICLE WINDOW ESCAPE DEVICE

(76) Inventor: John W. Bergacker, 1009 NE. 104 St., Miami Shores, FL (US) 33138

( * ) Notice: Subject to any disclaimer, the term of this patent is extended or adjusted under 35 U.S.C. 154(b) by 0 days.

(21) Appl. No.: 09/523,174

(22) Filed: Mar. 10, 2000

(51) Int. Cl.[7] ..... B25D 1/00
(52) U.S. Cl. ..... 81/20; 81/20; 7/165
(58) Field of Search ..... 81/20, 27, 463; 7/165

(56) References Cited

U.S. PATENT DOCUMENTS

| | | | | |
|---|---|---|---|---|
| 623,792 | * | 4/1899 | Lans | 7/143 |
| 947,391 | * | 1/1910 | Michael | 81/463 |
| 1,572,046 | * | 2/1926 | Seiler | 81/463 |
| 2,384,707 | * | 9/1945 | Sweet | 30/367 |
| 2,490,684 | * | 12/1949 | Gosselin | 81/463 |
| 2,594,901 | * | 4/1952 | Forster | 81/463 |
| 3,172,204 | * | 3/1965 | Frey | 30/367 |
| 4,268,927 | * | 5/1981 | Bridwell | 7/143 |
| 4,570,339 | * | 2/1986 | Taylor | 30/2 |
| 4,672,745 | * | 6/1987 | Wilkens | 30/340 |
| 5,263,389 | * | 11/1993 | Frazzell et al. | 81/124.3 |
| 5,339,527 | * | 8/1994 | Clemens | 30/299 |
| 5,933,894 | * | 8/1999 | Bates | 7/164 |

* cited by examiner

*Primary Examiner*—James G. Smith
*Assistant Examiner*—Hadi Shakeri
(74) *Attorney, Agent, or Firm*—Michael W. York

(57) ABSTRACT

A vehicle window escape device having a cylindrical body portion with a handle at one end and a projecting pointed member at the other end for imparting a smashing blow to a vehicle window to cause the window to shatter. The body portion is hollow and contains a spring force exerting system for providing a blow to the projecting pointed member when the end of the projecting pointed member is pressed against the vehicle window through the use of the handle by an occupant of the vehicle.

5 Claims, 1 Drawing Sheet

VEHICLE WINDOW ESCAPE DEVICE

BACKGROUND OF THE INVENTION

In many instances it is important for the occupant of a vehicle to rapidly escape from the vehicle. This is true for instance when the vehicle has been involved in an accident and is on fire. In such a situation it may be difficult or impossible to leave the vehicle through the normal exit doors or the like since they may be jammed due to the accident or the doors could be blocked by some object. In the case of a vehicle that ends up in a body of water such as canal the water pressure may prevent opening of the door. In many such instances unless there is someone outside the vehicle who can gain access to the interior of the vehicle, the occupant or occupants may perish.

Most, if not all, vehicles have windows or openings covered by tempered glass but these may not readily open and generally an occupant would have trouble breaking them since they are very strong and are designed to withstand pressure and impact. However, all vehicle side and back windows are tempered glass so that they shatter upon impact by a sharp object so that they do not leave large pieces of glass that can cause injury. As a result, it is easy to exit a vehicle through such a glass covered opening after the glass has been shattered by such a blow. Normally, a vehicle occupant does not have an object within the vehicle to provide the sharp blow that will shatter the glass.

As a consequence, there is a definite need for a device that can be conveniently located in a vehicle that can be readily used by the occupant of the vehicle to escape through a glass covered opening in the vehicle should the need arise. This vehicle window escape device invention satisfies this need. The vehicle window escape device is light weight, compact and is readily used by most occupants of a vehicle. In order to use the vehicle window escape device it is merely grasped by one hand of the occupant and its pointed end is pressed against the glass. This pushes a pointed plunger inward and results in a spring exerting a sharp blow against the plunger that shatters the glass and allows the occupant to escape from the vehicle.

SUMMARY OF THE INVENTION

This invention relates to vehicle escape apparatus and more particularly to vehicle escape apparatus for escaping through the side or back window of a vehicle.

Accordingly, it is an object of the invention to provide a vehicle window escape device for readily smashing a vehicle window.

It is an object of the invention to provide a vehicle window escape device which is easy to use.

It is an object of the invention to provide a vehicle window escape device which can be readily used by most persons.

It is an object of the invention to provide a vehicle window escape device which can be used with no training.

It is an object of the invention to provide a vehicle window escape device which works by merely pushing against glass.

It is an object of the invention to provide a vehicle window escape device which is convenient to keep in a vehicle.

It is an object of the invention to provide a vehicle window escape device which is compact.

It is an object of the invention to provide a vehicle window escape device which is easy to store.

It is an object of the invention to provide a vehicle window escape device which is light weight.

It is an object of the invention to provide a vehicle window escape device for which no maintenance is required.

It is an object of the invention to provide a vehicle window escape device which has a long life.

It is an object of the invention to provide a vehicle window escape device which has few parts.

It is an object of the invention to provide a vehicle window escape which is simple in its operation.

It is an object of the invention to provide a vehicle window escape device which is easy to manufacture.

It is an object of the invention to provide a vehicle window escape device which requires very little machining.

It is an object of the invention to provide a vehicle window escape device which is made using readily available tools.

It is an object of the invention to provide a vehicle window escape device which is made using readily available materials.

It is an object of the invention to provide a vehicle window escape device which is easy to assemble.

These and other objects of the invention will be apparent from the following description of the vehicle window escape device that includes an elongated body portion with two ends, a handle portion located at one end of the elongated body portion and a slender sharp pointed glass impact member projecting from the other end of the elongated body member. Force exerting means, including at least one spring, are located within the body portion for providing a force to the sharp pointed member to cause it to move outward rapidly from the end of the body member.

BRIEF DESCRIPTION OF THE DRAWINGS

The invention will be hereinafter more fully described with reference to the accompanying drawings in which.

DETAILED DESCRIPTION OF THE PREFERRED EMBODIMENT

Figures 1, 2, 3:
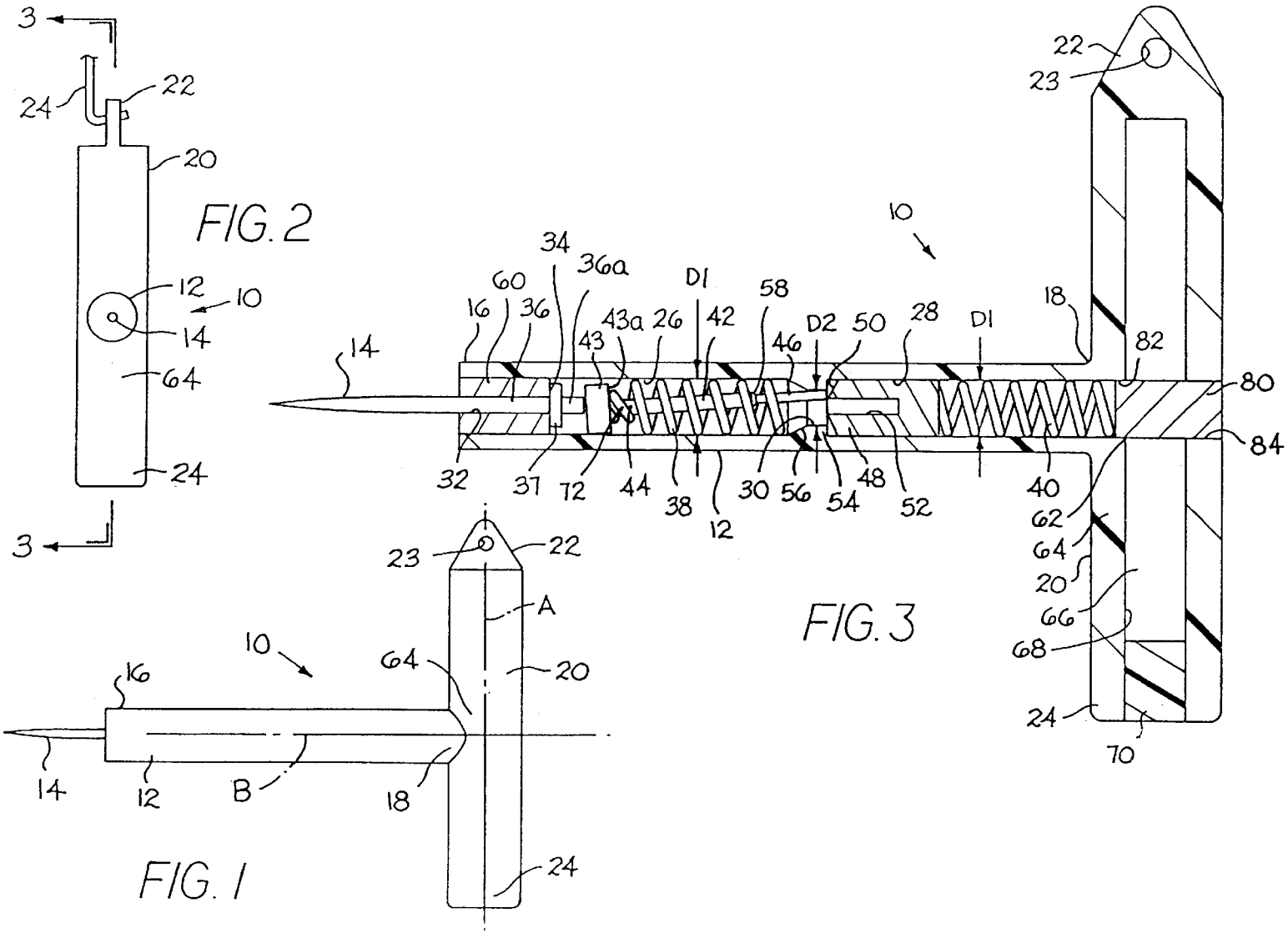
FIG. 1 is a side elevational view of the vehicle window escape device invention.
FIG. 2 is an end elevational view of the vehicle window escape device invention.
FIG. 3 is an enlarged sectional view of the vehicle window escape device taken on the line 3—3 FIG. 2.

As illustrated in FIGS. 1 and 2, the vehicle window escape device that is designated generally by the number 10 has a circular cross section shape elongated cylinder body portion 12 with a slender shape pointed rod 14 extending from the outer end portion 16 of the body portion 12. The inner end 18 or the end opposite the end 16 is attached to an elongated circular cross section handle portion 20 whose long axis A is substantially perpendicular to the long axis B of the cylindrical body portion 12.

The cylindrical handle portion 20 has two outer end portions 22 and 24. The outer end portion 22 is flattened and has a triangular pointed shape that can be used to hack away or clear automobile glass and the like after it has been shattered. The other outer end portion 24 is blunt shaped and is shaped to be used as a hammer head surface for striking and breaking glass and the like that may have resisted shattering in a manner that will hereinafter be described in detail. The flattened outer end portion 22 has a round hole 23 extending through it that is sized to accept a hook 24 or the like for storing the vehicle window escape device 10 with the hole 23 on the hook 24 within a vehicle so that it is readily available should the need for the use of the vehicle window escape device 10 arise in an emergency.

As illustrated in FIG. 3, a portion of the interior of body portion 12 is hollow. Specifically, the body portion 12 has two elongated cylindrical shaped chambers 26 and 28 that are interconnected by an circular cross section aperture 30 that has a smaller diameter D2 than the diameter D1 of the forward and rearward cylindrical chambers 26 and 28. The forward cylindrical chamber 26 has an aperture 32 in its forward wall 34 that is sized and shaped to slideably receive the pointed rod 14 that is part of a movable impact member 36 that has a cylindrical rear portion 36*a* with an outward extending circular stop 37.

Two compression springs 38 and 40 are located in the respective forward and rearward chambers 26 and 28. A striker member 42 is located immediately rearward of the impact member 36 in the forward chamber 26 in position to be biased in a forward direction by the compression spring 38. The striker member 42 has a short enlarged cylindrical portion 43 with a smaller diameter cylindrical portion 44 extending from its rearward surface 43*a* and a thin round projecting pin 46 extending rearward from the cylindrical portion 44. This projecting pin 46 is sized and located to reciprocate within the aperture 30 that interconnects the chambers 26 and 28.

A hammer member 48 is located in the rearward chamber 28 and has a forward tapered surface 50 and a centrally located hole 52 that is sized and located to receive the projecting pin 46 when the projecting pin 46 is aligned with the hole 52. The partition portion 54 that separates the hollow chambers 26 and 28 that has the interconnecting aperture 30 has a tapered surface 56 that is located and adapted to come into contact with the tapered conical surface 58 that exists between the projecting pin 46 and the adjacent cylindrical portion 44. The second compression spring 40 that is located in the rearward chamber 28 is located to exert a forward biasing force on the hammer member 48.

The parts inside the chamber 26 in the body portion 12 are secured in place by a plug 60 in the outer end portion 16 that also forms the wall 34 and also has the aperture 32 for the pointed rod 14. The other end portion 18 of the body portion 12 is secured to the center portion 64 of the cylindrical handle portion 20 and the parts in the chamber 28 are secured in place by a plug 80 that fits into the outer end portion 82 of the chamber 28 and passes through and seals a circular hole 84 in the outer wall of the handle portion 20. In the preferred embodiment, the handle portion 20 has a flotation chamber 66 that is formed by the hole 68 in the handle portion 20 and the associated plug 70 that is located in and seals the outer end portion of the hole 68. This flotation chamber 66 reduces the weight of the vehicle window escape device 10 to permit the vehicle window escape device 10 to float in water and hence be available for use in a vehicle that is filling with water.

The vehicle window escape device 10 is made in the following manner. Both the body portion 12 and the handle portion 20 are molded as one piece from a suitable plastic known in the art using conventional plastic molding equipment. If a suitable density polypropylene plastic is used the vehicle window escape device 10 will float in water without the need for any flotation chamber 66 in the handle portion 20. In molding the body portion 12 and the handle portion 20, the various cavities such as the chambers 26 and 28 and the hole 23 and the hole 62 in the handle portion 20 can be formed in a mold to their final shape to eliminate machining. In the preferred embodiment, plastic containing a photo luminescent material is used in molding the body portion 12 and the handle portion 20 to cause the body portion 12 and the handle portion 20 to glow in the dark so that the vehicle window escape device 10 can be readily located when it is dark and might not be readily visible otherwise. The plug 60 can also be molded with its aperture 32 in a similar manner with or without the photo luminescent material in the plastic that is used to mold the plug 60 and the same is also true for the plugs 70 and 80.

The impact member 36, the striker member 42 and the hammer member 48 can be machined using conventional equipment and techniques known in the art from a suitable grade of steel. Stainless steel is preferred to prevent possible rust or as an alternative these parts can be suitably plated to resist rust. The springs 38 and 40 are conventional compression springs that are readily available but the spring 40 should be stronger than the spring 38. However, the spring 38 has a smaller diameter portion 72 that fits snugly around the cylindrical portion 44 of the striker member 42 close to the enlarged portion 43. This spring portion 72 has an axis that makes an angle with the long axis of the remainder of the spring 38. Since the smaller diameter portion 72 contacts the portion 43 at the surface 43*a* at an angle, this causes the striker member 42 to tilt as illustrated in FIG. 3.

In order to use the vehicle window escape device 10 it is stored in a vehicle at a suitable location where it can be readily seen by the occupants and where they could readily grasp it in order to use it. In this connection, the vehicle window escape device 10 can be stored by hanging it from the hook 24 through the use of the hole 23 in the end portion 22 of the handle portion 20. When an emergency occurs that makes it necessary or desirable to break the vehicle's window glass, an occupant of the vehicle would locate the vehicle window escape device 10. The fact that the the vehicle window escape device 10, in the preferred embodiment, is in part made from a photo luminescent material will assist in locating the vehicle window escape device 10 when it is dark or there is a lack of adequate light. When the vehicle window escape device 10 is located, the occupant grasps the handle portion 20 and presses the tip of the slender shaped pointed rod 14 against the vehicle window glass that is to be broken.

The occupant then pushes hard on the handle portion 20 towards the window and this results in the slender shape pointed rod 14 being pushed into the body portion 12 and the springs 38 and 40 being compressed. In this connection, inward pressure on the slender shape pointed rod 14 causes the entire impact member 36 to be pushed inward and this in turn causes the striker member 42 to compress the adjacent spring 38 and since the projection 46 on the striker member 42 is off center the projection 46 pushes against the hammer member 48 that in turn compresses the spring 40. Further pressure on the handle portion 20 causes the striker member 42 to move inward or to the right as viewed in FIG. 3 and the tapering surface 58 adjacent the portion 44 will move into contact with the tapering or conical surface 56 of the partition portion 54 in the body portion 12. This causes the striker member 42 and its projecting pin portion 46 to move from its off center position to a central position within the body portion 12. This will result in the projecting pin 46 being aligned with the hole 52 in the hammer member 48 and when this occurs the hammer member 48 moves rapidly to the left as viewed in FIG. 3 under the force exerted by the spring 40.

When the bottom of the hole 52 in the the hammer member 48 strikes the projecting pin 46 the hammer member 48 imparts a sharp blow to the striker member 42 that is in turn imparted to the impact member 36 that causes the pointed rod portion 14 of the impact member 36 to give a sharp blow to the glass and break the window. After this is done, the end portions 22 and 24 of the handle portion 20 can be used to clear away any remaining glass and provide an exit for the occupants of the vehicle through the broken window.

Although the invention has been described in considerable detail with reference to a certain preferred embodiment, it will be understood that variations or modifications may be made within the spirit and scope of the invention as defined in the appended claims.

What is claimed is:

1. In a vehicle window breaking escape device with a movable vehicle window glass impact member and associated force exerting means for exerting a force to cause said impact member to strike and break a vehicle window wherein the improvement comprises:

a plastic elongated cylindrical straight handle portion having a long axis with at least a portion thereof being luminescent and having two opposite end portions and a center portion and at least one flotation chamber for causing said vehicle window breaking escape device to float in water, one of said two opposite end portions having means for storing said vehicle window breaking escape device within a vehicle comprising a flattened projection having a hole located therein;

a plastic elongated cylindrical straight body portion with a long axis projecting from the center portion of said plastic elongated cylindrical straight handle portion with the long axis of said plastic elongated cylindrical straight body portion being substantially perpendicular to the long axis of said plastic elongated cylindrical straight handle portion, said plastic elongated cylindrical straight body portion having forward and rearward elongated cylindrical shaped chambers located therein separated by a partition with a tapering surface formed from part of said plastic elongated cylindrical straight body portion with an aperture in the partition connecting said forward and rearward elongated cylindrical shaped chambers; and a striker member with a cylindrical portion and an adjacent located for movement in said forward and rearward elongated cylindrical shaped chambers conical surface and a projecting pin portion, and an associated rearward compression spring and a fordward compression spring located within said two elongated cylindrical shaped chambers along with a portion of said movable vehicle window glass impact member and said associated force exerting means, said forward compression spring having a portion thereof with an axis located around the cylindrical portion of said striker member and the remainder of said forward compression spring having a long axis with the axis of the spring portion located around the cylindrical portion of said striker member forming an angle with the long axis of the remainder of said forward compression spring to cause said striker member to assume a tilted position, said tapering surface formed from part of said body portion being located to come in contact with the conical surface of said striker member to cause said striker member to move from the tilted position and cause operation of said force exerting means.

2. The vehicle window breaking escape device for breaking a vehicle window of claim 1 wherein said luminescent portion is photo luminescent.

3. The vehicle window breaking escape device for breaking a vehicle window of claim 2 wherein said flattened projection is pointed for use in smashing broken glass.

4. The vehicle window breaking escape device for breaking a vehicle window of claim 3 wherein the other end portion of said two opposite end portions of said plastic elongated cylindrical straight handle portion has a blunt hammer face for use in breaking cracked glass.

5. The vehicle window breaking escape device for breaking a vehicle window of claim 4 wherein one of said two elongated cylindrical shaped chambers in said plastic elongated cylindrical straight body portion has an opening extending into said plastic elongated cylindrical straight handle portion and said plastic elongated cylindrical straight handle portion has an aperture located to receive a plug for sealing the opening of the elongated chamber extending into said plastic elongated cylindrical straight handle portion and further comprising a plug located in the opening of the elongated chamber extending into said plastic elongated cylindrical straight handle portion and in the aperture located in said plastic elongated cylindrical straight handle portion.

* * * * *